US007299667B1

(12) United States Patent
Miresmaili

(10) Patent No.: US 7,299,667 B1
(45) Date of Patent: Nov. 27, 2007

(54) VAULT ASSEMBLY

(76) Inventor: Masoud S. Miresmaili, 601 E. Juanita Ave., San Dimas, CA (US) 91773

( * ) Notice: Subject to any disclaimer, the term of this patent is extended or adjusted under 35 U.S.C. 154(b) by 19 days.

(21) Appl. No.: 11/446,279

(22) Filed: Jun. 2, 2006

(51) Int. Cl.
*E05B 73/00* (2006.01)

(52) U.S. Cl. ..... 70/58; 70/63; 70/159; 109/51; 109/52; 220/481; 248/551

(58) Field of Classification Search ..... 70/58, 70/62, 63, 57.1, 158–162; 109/50–52; 312/111, 312/245; 403/348, 349, 353; 220/480, 481; 248/551–553
See application file for complete search history.

(56) References Cited

U.S. PATENT DOCUMENTS 1,634,884 A * 7/1927 Peer ..... 109/51
2,343,750 A * 3/1944 Conran ..... 131/237
2,754,991 A * 7/1956 Hagerty et al. ..... 220/481
4,266,703 A * 5/1981 Litz ..... 224/443
4,325,531 A * 4/1982 Omholt ..... 248/553
4,469,345 A * 9/1984 Weiss ..... 224/425
4,577,563 A * 3/1986 Sidler ..... 109/52
4,603,829 A * 8/1986 Koike et al. ..... 248/553
4,648,737 A * 3/1987 Lake et al. ..... 403/322.4
4,739,637 A * 4/1988 Finkel et al. ..... 70/58
4,987,836 A * 1/1991 Owen ..... 109/52
5,082,233 A * 1/1992 Ayers et al. ..... 248/553
5,170,907 A * 12/1992 Sakai ..... 220/481
5,738,020 A 4/1998 Correia
5,778,804 A * 7/1998 Read ..... 248/221.12
5,870,910 A * 2/1999 Specht ..... 70/58

* cited by examiner

*Primary Examiner*—Lloyd A. Gall
(74) *Attorney, Agent, or Firm*—Calif Tervo; Palomar Patent

(57) ABSTRACT

A vault assembly generally comprises a lock box, an anchor bracket, and a locking member. The lock box includes a mounting wall having a plurality of outward extending hooks arranged in a spaced pattern and a locking opening. The anchor bracket includes a panel for attachment of the lock box including one or more locking openings and a plurality of joining openings for receiving the hooks. The locking member is disposed in the box and includes a locking shaft for insertion in the locking openings and a locking flange on the end to prevent withdrawal. The lock box mounting wall can be attached in a plurality of positions to either side of the panel.

16 Claims, 2 Drawing Sheets

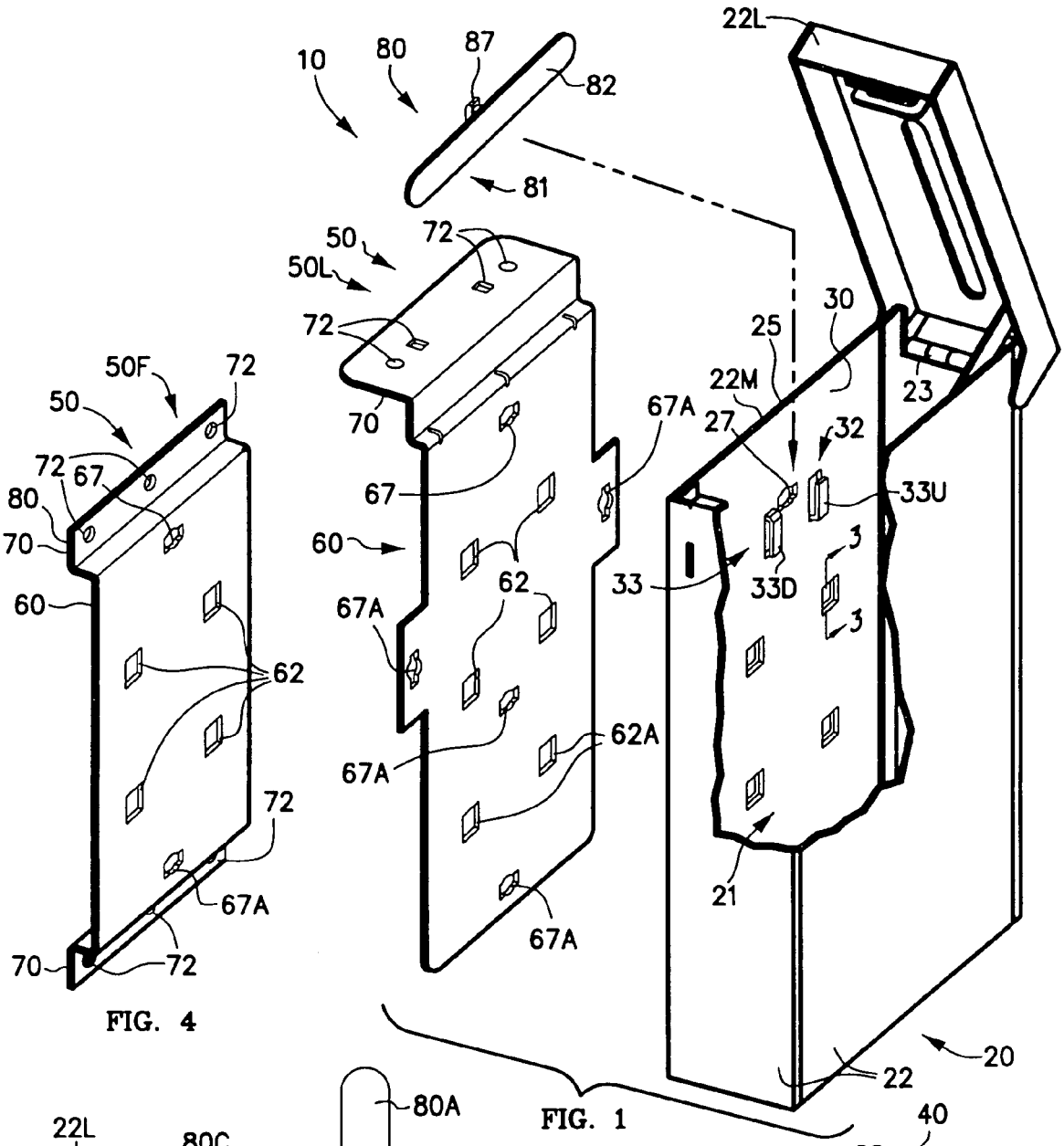
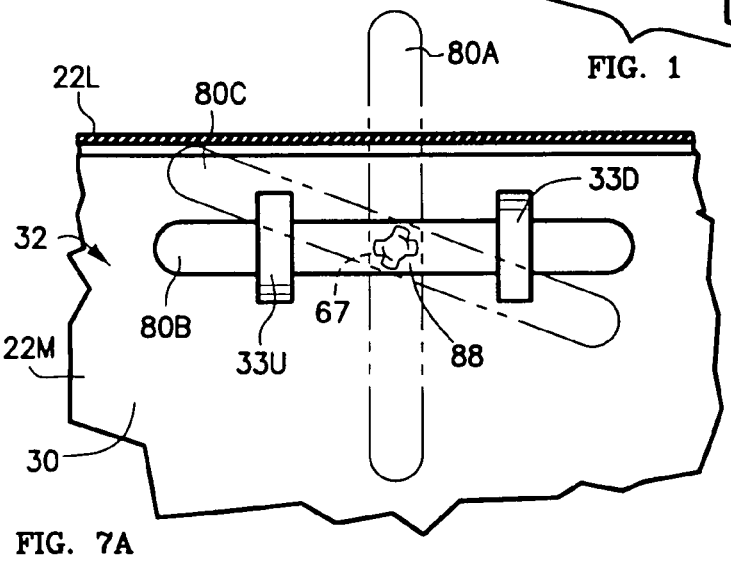
FIG. 7A
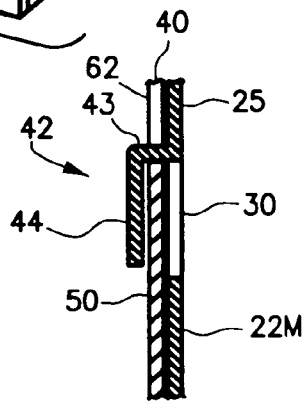
FIG. 3

VAULT ASSEMBLY

FIELD OF THE INVENTION

This invention relates, in general, to a vault assembly including a lock box and mount combination wherein the lock box is easily removable from the mount by the user and, more specifically, wherein the lock box can be attached to the mount in several configurations.

DESCRIPTION OF THE RELATED ART

Common devices for securing articles include safes, vaults and permanently mounted containers. These devices do not allow for easy accessibility or secure movement of the secured articles.

Guns and valuables may be hidden in custom made appliances such as clocks and picture frames. These devices permit easy accessibility but not theft or security from unwanted hands.

A shortcoming of conventional small, portable vaults, such as for guns, that are mounted for accessibility, is that a wide variety of mounting and locking attachments are desired so that a given user can mount the vault in a desired manner. However, conventional mounting devices and methods require different mounting devices and locking devices for different mounting configurations.

SUMMARY OF THE INVENTION

A vault assembly generally comprises a lock box, an anchor bracket, and a locking member. The lock box defines a closed cavity including a mounting wall having a plurality of outward extending hooks arranged in a spaced pattern and a locking opening. The anchor bracket is adapted for attachment to a secure surface and includes a panel for attachment of the lock box including one or more locking openings and a plurality of joining openings adapted for receiving the plurality of hooks such that the lock box is movable with relative normal movement of the panel and the mounting wall between a free position and an engaged position wherein the hooks are received by the joining openings and wherein the mounting wall and the panel are proximate and parallel and such that the lock box is movable with relative sliding of the mounting wall and the panel between the engaged position and a joined position wherein the joining flanges overlap the panel thereby preventing relative normal movement of the mounting wall and the panel and wherein a locking opening of the panel is aligned with the locking opening of the wall. The locking member includes a body, a locking shaft extending from the body, and a locking flange on the end of the locking shaft. The locking member is inserted in the lock box and movable between a free position and a locked position wherein the locking shaft is inserted into the aligned locking openings of the mounting wall and the panel in the joined position such that the mounting wall and the panel are retained in the joined position and wherein the body is rotated such that the locking flange overlaps the panel such that the locking shaft is retained in the aligned locking openings.

The locking box can be attached to both sides of the panel in a plurality of positions.

Other features and many attendant advantages of the invention will become more apparent upon a reading of the following detailed description together with the drawings wherein like reference numerals refer to like parts throughout.

BRIEF DESCRIPTION OF THE DRAWINGS

FIG. 1 is an exploded, top, front, left side view of an embodiment of the vault assembly.

FIG. 3 is an enlarged sectional view of a hook taken on line 3-3 of FIG. 1

FIG. 4 is an alternate embodiment of the mounting bracket.

FIG. 7A is a partial front view of the mounting wall of the lock box showing the locking movement of the locking member.

DETAILED DESCRIPTION OF THE INVENTION

Figure 2:
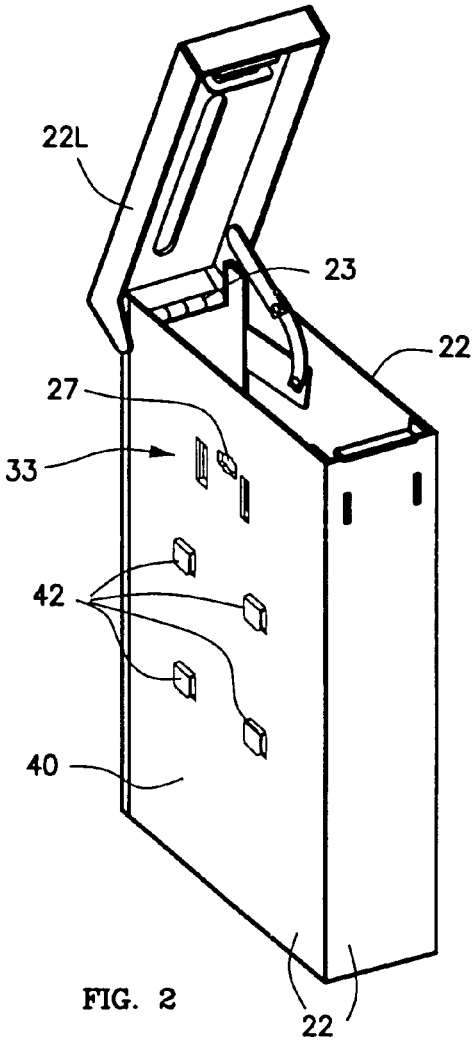
FIG. 2 is an exploded, top, rear, right side view of the lock box of FIG. 1.
Figure 5:
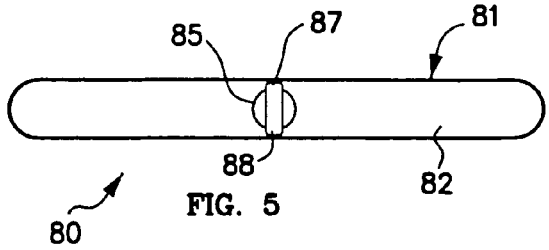
FIG. 5 is an enlarged rear elevation view of the locking member of FIG. 1.
Figure 6:
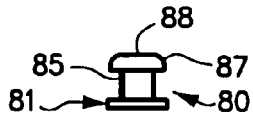
FIG. 6 is an end view of the locking member of FIG. 5.

With reference now to the drawings, and more particularly to FIGS. 1-6 thereof; there is shown in FIG. 1 an exploded, top, front, left side view of an embodiment of a vault assembly 10 including a lock box 20, a mounting bracket 50, such as L-shaped bracket 50L and a locking member 80. In FIG. 2 there is shown an exploded, top, rear, right side view of lock box 20 of FIG. 1; in FIG. 3 there is shown an enlarged sectional view of a hook 42 taken on line 3-3 of FIG. 1, and in FIG. 4 an alternate embodiment of mounting bracket 50, such as flat bracket 50F. FIG. 5 is an enlarged rear elevation view of the locking member 80 of FIG. 1 and FIG. 6 is an end view of locking member 80 of FIG. 5.

In general, lock box 20 includes walls 22 defining a closed cavity 21; mounting bracket 50 includes one or more attachment portions 70 and a joining panel 60; and locking member 80 includes a body 81, a locking shaft 85, and a locking flange 87.

Figure 9:
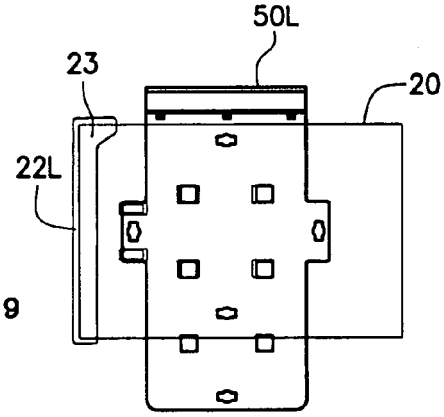
FIG. 9 is a reduced front elevation view of the lock box of FIG. 1 joined in a horizontal configuration to the mounting bracket of FIG. 1.

Lock box 20 includes at least one wall 22, such as lid 22L, which is movable between an open position, shown in FIG. 1, and a closed position, shown in FIG. 9. Lid 22L, shown, is hinged, such as by piano hinge 23, to the remainder of box 20. Lid 22L may be locked in the closed position by any suitable locking device, as is well known in the art, so is not shown or described. Lock box 20 is typically made of strong material, such as steel.

Lock box 20 includes a mounting wall 22M for mounting lock box 20 on mounting bracket 50. In the exemplary embodiment, mounting wall 22M is a steel panel 25 having a front face 30 and a rear face 40. Rear face 40 includes means, such as a plurality of hooks 42 extending outward therefrom, for attaching mounting wall 22M to mounting bracket 50. Each hook 42 includes a rearward projecting joining shaft 43 having a free end and a joining flange 44 attached to the free end. All joining flanges 44 project in the same direction from shafts 43. Preferably, shafts 43 have a length that is slightly greater than the thickness of joining panel 60 of mounting bracket 50. Preferably, hooks 42 are cut and pressed out of panel 25, but may be of a separate source and attached to panel 25 such as by welding. Hooks 42 are arranged in a spaced pattern for greater joining strength. Panel 25 includes an elongate locking opening 27 therethrough.

Attachment portions 70 of mounting bracket 50 provide means for attachment of bracket 50 to a secure surface, such as a floor, wall, cabinet, or bed frame. Attachment portions 70 include openings 72 for disposition of fasteners, such as bolts, nails or screws. On flat bracket 50F, attachment portions 70 hold joining panel 60 parallel to and slightly spaced from the secure surface. On L-shaped bracket 50L, attachment portion 70 is perpendicular to joining panel 60 and holds joining panel 60 perpendicular to the secure surface.

Joining panel 60 includes one or more elongate locking openings 67 therethrough. Joining panel 60 includes a plurality of joining openings 62 therethrough arranged and adapted for receiving the plurality of hooks 42 such that lock box 20 is movable with relative normal movement of joining panel 60 and mounting wall 22M between a free position and an engaged position wherein hooks 42 are received by joining openings 62 and wherein mounting wall 22M and joining panel 60 are proximate and parallel and such that lock box 20 is then movable with relative sliding of mounting wall 22M and joining panel 60 between the engaged position and a joined position wherein joining flanges 44 overlap joining panel 60 thereby preventing relative normal movement of mounting wall 22M and joining panel 60 and wherein a locking opening 67 of joining panel 60 is aligned with locking opening 27 of mounting wall 22M.

Figure 8:
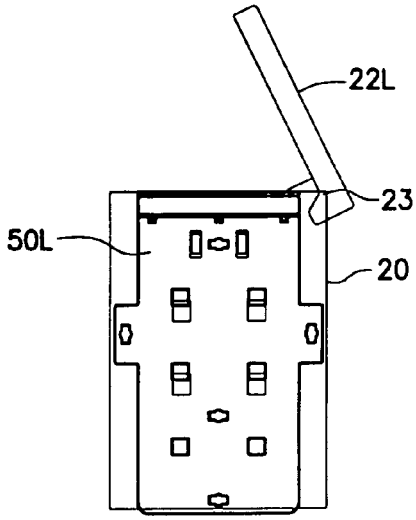
FIG. 8 is a reduced front elevation view of the lock box of FIG. 1 joined in an upward-opening, vertical configuration to the mounting bracket of FIG. 1.

FIG. 8 is a reduced front elevation view of lock box 20 of FIG. 1 joined in an upward-opening, vertical configuration to mounting bracket 50 of FIG. 1 and as described above.

Figure 7B:
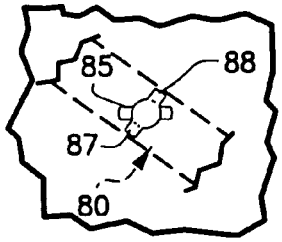
FIG. 7B is a partial rear view of the mounting wall of the lock box showing the locking movement of the locking member.

Returning to FIGS. 5 and 6 and adding FIG. 7A and FIG. 7B, FIG. 5 is an enlarged rear elevation view of locking member 80 of FIG. 1, FIG. 6 is an end view of the locking member of FIG. 5, FIG. 7A is a partial front view of mounting wall 22M of lock box 20 showing the locking movement of locking member 80, and FIG. 7B is a partial rear view of the mounting wall of the lock box showing the locking movement of the locking member.

Locking member 80 is used to lock lock box 20 and mounting bracket 50 in the joined position. Locking member 80 includes a body 81, a locking shaft 85, and a locking flange 87. Body 81 comprises an elongate bar 82 having a longitudinal axis. Locking shaft 85 protrudes from the rear side of bar 82, preferably at the longitudinal center of bar 82, and preferably is cylindrical with a diameter adapted for insertion in aligned locking openings 27, 67, and, typically, has a length slightly greater than the thickness of the joined panels 25, 60. Locking flange 87, such as rectangular toggle 88, is attached to free end of locking shaft 85.

Locking member 80 is movable between a free position and a locked position. This movement is shown in FIGS. 7A and 7B. With locking member 80 in position 80A, toggle 88 is inserted through the aligned locking openings 27, 67 and locking shaft 85 is inserted into the aligned locking openings 27, 67 of mounting wall 22M and joining panel 60 in the joined position. Mounting wall 22M and joining panel 60 are thereby retained by shaft 85 from sliding relative to one another and are thus retained in the joined position. Locking member 80 is then rotated to position 80B. Toggle 88 is adapted for insertion at position 80A through the aligned locking openings 27, 67 and for overlapping joining panel 60 at positions 80B and 80C so as to not be withdrawable. Retaining means 32, such as L-brackets 33, such as upward and downward opening L-brackets 33U, 33D on front face of mounting wall 22M, help retain locking member 80 in the locked position. Upon rotation, body 81 slides between L-brackets 33U, 33D and the front face 30 of panel 25. Both toggle 88 and L-brackets 33 retain locking shaft 85 in the locked position by preventing locking member 80 from moving forward. Locking shaft 85 has a diameter in the locked position substantially spanning the width of locking openings 27, 67 such that mounting wall 22M and joining panel 60 cannot slide sufficiently relative to one another to become un-joined.

Lock box 20 includes stop means for preventing rotation of locking member 80 from the locked position. The stop means may be any retaining, grabbing or anchoring device as are well know. However, in the illustrated embodiment, the stop means comprises lid 22L and locking member 80 adapted such that locking member 80 is prevented by lid 22L in the closed position from rotating sufficiently for toggle 88 to be withdrawn from locking openings 27, 67. This is illustrated as position 80C in FIG. 7. In this embodiment, a part of locking member 80, such as the end of bar 82 of body 81, is sufficiently long to encounter closed lid 22L before toggle 88 is disengaged. Thus, so long as lid 22L is closed, toggle 88 cannot disengage from the locked position.

Figure 10:
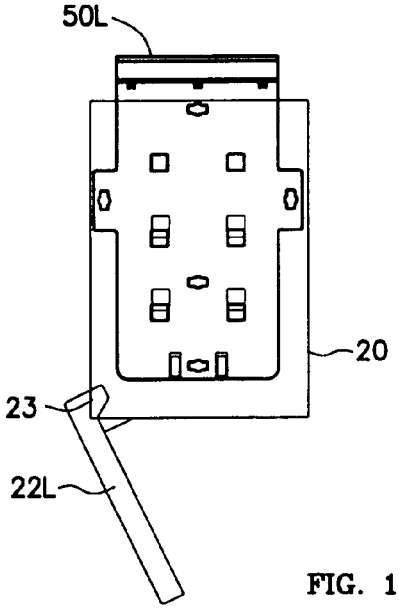
FIG. 10 is a reduced front elevation view of the lock box of FIG. 1 joined in a downward opening, vertical configuration to the mounting bracket of FIG. 1.

Further including FIGS. 8, 9, and 10, there are shown some others of the numerous mounting configurations of lock box 20 onto mounting bracket 50, such as on L-shaped bracket 50L. FIG. 8 is a reduced front elevation view of lock box 20 of FIG. 1 joined in an upward-opening, vertical configuration to mounting bracket 50L of FIG. 1. FIG. 9 is a reduced front elevation view of lock box 20 of FIG. 1 joined in a horizontal configuration to mounting bracket 50L of FIG. 1. FIG. 10 is a reduced front elevation view of lock box 20 of FIG. 1 joined in a downward opening, vertical configuration to mounting bracket 50L of FIG. 1.

Hooks 42 of mounting wall 22M of lock box 20 and cooperating joining openings 62 of joining panel 60 are arranged in a pattern, such as of a matrix or square pattern, such that joining openings 62 still receive hooks 42 if box 20 is rotated in the plane of panel 25, such as by 90° or 180°. In the exemplary embodiment, hooks 42 and joining openings 62 are arranged symmetrically about a longitudinal axis and about a transverse axis such that the same joining openings 62 can be used to receive hooks 42 after 90° rotations. Lock box 20 can be attached to flat bracket 50F in 180° opposed positions. Lock box 20 can be attached to the front side of L-bracket 50L in the vertical position of FIG. 8 (twelve o'clock), the horizontal position (nine o'clock) with hinge 23 on top as shown in FIG. 9, the inverted vertical position (six o'clock) with lid 22L on the bottom as shown in FIG. 10, and the horizontal position (three o'clock) with hinge 23 on the bottom (not shown). In these alternate mounting configurations, additional locking openings 67A in brackets 50 align with locking opening of lock box 20 for receiving locking member 80. Mounting bracket 50L includes additional joining openings 62A so that a long lock box 20 can be attached as shown in FIG. 10 should bracket 50L be attached to a large planar surface such that box 20 cannot project upward past attachment portion 70. Alternately, but not shown, a single locking opening at the center of the matrix could be used.

Lock box 20 can also be attached, in positions not shown, to the rear side of mounting bracket 50L in a horizontal position (nine o'clock) such that hinge 23 is at the bottom, in a horizontal position (three o'clock) such that hinge 23 is on top, and in a vertical position (six o'clock) with hinge 23 on the right.

When mounted to bracket 50F, Lock box 20 is adapted, such as by being of sufficient size, for preventing access to fasteners in fastener openings 72 of attachment portions 70, thus preventing removal of bracket 50F from the secure surface. When mounted to the side of L-shaped bracket 50L having attachment portion 70, lock box 20 is adapted, such as by being of sufficient size and proximity, for preventing access to fasteners in fastener openings 72 of attachment portion 70, thus preventing removal of bracket 50L from the secure surface.

Having described the invention, it can be seen that it provides a very convenient assembly for mounting a vault such that the vault is readily accessible.

Although a particular embodiment of the invention has been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

I claim:

1. In combination:

a lock box defining a closed cavity including:
- a mounting wall including:
  - a plurality of hooks extending outward from said mounting wall and arranged in a spaced pattern; each hook including:
    - a joining shaft; and
    - a joining flange; and
  - a locking opening;

a bracket adapted for attachment to a surface and including:
- a panel for attachment to said lock box including:
  - one or more locking openings; and
  - a plurality of joining openings adapted for receiving said plurality of hooks such that said lock box is movable with relative normal movement of said panel and said mounting wall between a free position and an engaged position wherein said hooks are received by said joining openings and wherein said mounting wall and said panel are proximate and parallel and such that said lock box is movable with relative sliding of said mounting wall and said panel between the engaged position and a joined position wherein said joining flanges overlap said panel thereby preventing relative normal movement of said mounting wall and said panel and wherein a locking opening of said panel is aligned with said locking opening of said wall; and a locking member for disposition in said lock box including:
- a body;
- a locking shaft extending from said body including:
  - a free end; and
- a locking flange on said free end of said locking shaft; said locking member movable between a free position and a locked position wherein said locking shaft is inserted into the aligned said locking openings of said mounting wall and said panel in the joined position such that said mounting wall and said panel are retained in the joined position and wherein said body is rotated such that said locking flange overlaps said panel such that said locking shaft is retained in the aligned said locking openings.

2. The combination of claim 1 wherein:

said arranged spaced pattern of said hooks is such that said joining openings receive said hooks for joining said wall and said panel also when said mounting wall is rotated 90 degrees.

3. The combination of claim 1 wherein:

said arranged spaced pattern of said hooks is such that said joining openings receive said hooks for joining said wall and said panel also when said mounting wall is rotated 180 degrees.

4. The combination of claim 3 wherein:

said arranged spaced pattern of said hooks is such that said joining openings receive said hooks for joining said wall and said panel also when said mounting wall is rotated 90 degrees.

5. The combination of claim 1 wherein:

said lock box includes:
- a lid having a closed position and an open position; said lid in the closed position retaining said locking member in the locked position.

6. The combination of claim 5 wherein:

said lock box includes:
- retaining the means for retaining locking shaft in the locked position by preventing the locking member from moving forward when in the locked position.

7. The combination of claim 6 wherein:

said retaining means includes:
- an upward opening L-bracket; and
- a downward opening L-bracket.

8. The combination of claim 1 wherein:

said hooks are arranged in a matrix symmetrically about a longitudinal axis and about a transverse axis.

9. In combination:

a lock box defining a closed cavity including:
- a mounting wall including:
  - a plurality of hooks extending outward from said mounting wall and arranged in a spaced pattern; each hook including:
    - a joining shaft; and
    - a joining flange; and
  - a locking opening;

a bracket adapted for attachment to a surface and including:
- a panel for attachment to said lock box including:
  - a generally planar front side;
  - a generally planar rear side;
  - one or more locking openings therethrough between said front side and said rear side; and
  - a plurality of joining openings therethrough between said front side and said rear side adapted for receiving said plurality of hooks from either said front side or said rear side such that said lock box is movable with relative normal movement of said panel and said mounting wall between a free position and an engaged position wherein said hooks are received by said joining openings and wherein said mounting wall and said panel are proximate and parallel and such that said lock box is movable with relative sliding of said mounting wall and said panel between the engaged position and a joined position wherein said joining flanges overlap said panel thereby preventing relative normal movement of said mounting wall and said panel and wherein a locking opening of said panel is aligned with said locking opening of said wall; and a locking member for disposition in said lock box including:

a body;

a locking shaft extending from said body including:

a free end; and a locking flange on said free end of said locking shaft; said locking member movable between a free position and a locked position wherein said locking shaft is inserted into the aligned said locking openings of said mounting wall and said panel in the joined position such that said mounting wall and said panel are retained in the joined position and wherein said body is rotated such that said locking flange overlaps said panel such that said locking shaft is retained in the aligned said locking openings.

10. The combination of claim 9 wherein:

said arranged spaced pattern of said hooks is such that said joining openings receive said hooks for joining said wall and said panel also when said mounting wall is rotated 90 degrees.

11. The combination of claim 9 wherein:

said arranged spaced pattern of said hooks is such that said joining openings receive said hooks for joining said wall and said panel also when said mounting wall is rotated 180 degrees.

12. The combination of claim 11 wherein:

said arranged spaced pattern of said hooks is such that said joining openings receive said hooks for joining said wall and said panel also when said mounting wall is rotated 90 degrees.

13. The combination of claim 12 wherein:

said lock box includes:

a lid having a closed position and an open position; said lid in the closed position retaining said locking member in the locked position.

14. The combination of claim 13 wherein:

said lock box includes:

retaining means for retaining locking shaft in the locked position by preventing the locking member from moving forward when in the locked position.

15. The combination of claim 14 wherein:

said retaining means includes:

an upward opening L-bracket; and a downward opening L-bracket.

16. The combination of claim 9 wherein:

said hooks are arranged in a matrix symmetrically about a longitudinal axis and about a transverse axis.

* * * * *